US009278779B2

(12) United States Patent
Funaki

(10) Patent No.: US 9,278,779 B2
(45) Date of Patent: Mar. 8, 2016

(54) PALLET

(71) Applicant: KYOCERA Document Solutions Inc., Osaka (JP)

(72) Inventor: Keiichi Funaki, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/603,533

(22) Filed: Jan. 23, 2015

(65) Prior Publication Data

US 2015/0210426 A1 Jul. 30, 2015

(30) Foreign Application Priority Data

Jan. 27, 2014 (JP) ..... 2014-012164

(51) Int. Cl.
*B65D 19/00* (2006.01)
*B65D 19/38* (2006.01)
(Continued)

(52) U.S. Cl.
CPC ..... *B65D 19/385* (2013.01); *B65D 19/06* (2013.01); *B65D 21/0228* (2013.01); *B65D 81/05* (2013.01); *B65D 2519/00019* (2013.01); *B65D 2519/00024* (2013.01); *B65D 2519/00029* (2013.01); *B65D 2519/00034* (2013.01); *B65D 2519/00054* (2013.01); *B65D 2519/00059* (2013.01); *B65D 2519/00064* (2013.01); *B65D 2519/00069* (2013.01); *B65D 2519/0081* (2013.01); *B65D 2519/00089* (2013.01); *B65D 2519/0091* (2013.01); *B65D 2519/00094* (2013.01); *B65D 2519/0094* (2013.01); *B65D 2519/0096* (2013.01); *B65D 2519/00099* (2013.01); *B65D 2519/00104* (2013.01); *B65D 2519/00159* (2013.01); *B65D 2519/00164* (2013.01); *B65D 2519/00169* (2013.01); *B65D 2519/00174* (2013.01); *B65D 2519/00194* (2013.01); *B65D 2519/00199* (2013.01); *B65D 2519/00203* (2013.01); *B65D 2519/00208* (2013.01); *B65D 2519/00273* (2013.01);
(Continued)

(58) Field of Classification Search
CPC ..... B65D 19/38; B65D 19/40; B65D 19/02; B65D 19/06; B65D 19/44; B65D 21/00
USPC ..... 108/53.1, 55.7, 55.3, 53.3
See application file for complete search history.

(56) References Cited

U.S. PATENT DOCUMENTS 4,445,614 A * 5/1984 Mitsumori et al. ..... 206/599
5,722,550 A * 3/1998 Ficker ..... 220/4.28
(Continued)

FOREIGN PATENT DOCUMENTS

JP 2012-6608 1/2012

*Primary Examiner* — Daniel Rohrhoff
(74) *Attorney, Agent, or Firm* — Wenderoth, Lind & Ponack, L.L.P.

(57) ABSTRACT

A pallet is configured to be stackable in a plurality of stages. The pallet includes a bottom plate, a top plate on which an object to be packed is placed, a leg member, and a sidewall member. The leg member connects the bottom plate and the top plate and is disposed along the outer edges of the bottom plate and the top plate. The sidewall member are vertically installed along the outer edge of the top plate and are formed with a connection hole to be used in a connection of an outside packing case that covers the object to be packed. When the pallet is stacked on a top plate of another pallet the leg member is provided with an engagement portion that is disposed in correspondence to a connection hole of a sidewall member of the other pallet.

6 Claims, 6 Drawing Sheets

(51) Int. Cl.
*B65D 19/06* (2006.01)
*B65D 21/02* (2006.01)
*B65D 81/05* (2006.01)

(52) U.S. Cl.
CPC ..... *B65D2519/00288* (2013.01); *B65D 2519/00318* (2013.01); *B65D 2519/00373* (2013.01); *B65D 2519/00497* (2013.01); *B65D 2519/00597* (2013.01); *B65D 2519/00661* (2013.01); *B65D 2519/00726* (2013.01)

(56) References Cited

U.S. PATENT DOCUMENTS

| | | | | |
|---|---|---|---|---|
| 5,823,349 | A * | 10/1998 | Bridges | 206/597 |
| 7,654,390 | B2 * | 2/2010 | Baechle et al. | 206/386 |
| 7,896,159 | B2 * | 3/2011 | Goda | 206/386 |
| 8,256,615 | B2 * | 9/2012 | Goda | 206/386 |
| 2007/0046810 | A1 * | 3/2007 | Borio | 348/373 |
| 2012/0273485 | A1 * | 11/2012 | Lapoint et al. | 220/7 |

* cited by examiner

PALLET

CROSS-REFERENCE TO RELATED APPLICATION(S)

This application is based upon and claims the benefit of priority from Japanese Patent Application No. 2014-012164 filed on Jan. 27, 2014, the entire contents of which are incorporated herein by reference.

BACKGROUND

Conventionally, for the carrying, storage and the like of an object to be packed of an electronic device and the like, there has been widely used a pallet on which the object to be packed is placed. In many cases, such a pallet is collected after being used (after being unpacked) and is reused (a so-called returnable type pallet) in consideration of environmental problems.

As such a type of pallet, for example, there has been proposed a rack for transportation including a pair of strut members vertically installed on a pallet member and a stay that connects the pair of strut members to each other. The rack for transportation is unpacked and then is collected in the state in which the stay and the strut members have been disassembled and sequentially stacked and received on the pallet member.

SUMMARY

A pallet according to one aspect of the present disclosure is configured to be stackable in a plurality of stages. The pallet includes a bottom plate, a top plate on which an object to be packed is placed, a leg member, and a sidewall member. The leg member connects the bottom plate and the top plate and is disposed along the outer edges of the bottom plate and the top plate. The sidewall member is vertically installed along the outer edge of the top plate and is formed with a connection hole to be used in a connection of an outside packing case that covers the object to be packed. When the pallet is stacked on a top plate of another pallet, the leg member is provided with an engagement portion that is disposed in correspondence to a connection hole of a sidewall member of the other pallet.

DETAILED DESCRIPTION

Hereinafter, the present embodiment will now be described with reference to the accompanying drawings. In addition, in the following description, for the purpose of convenience, each direction is defined as indicated by arrows in each drawing.

First Embodiment

Figure 1:
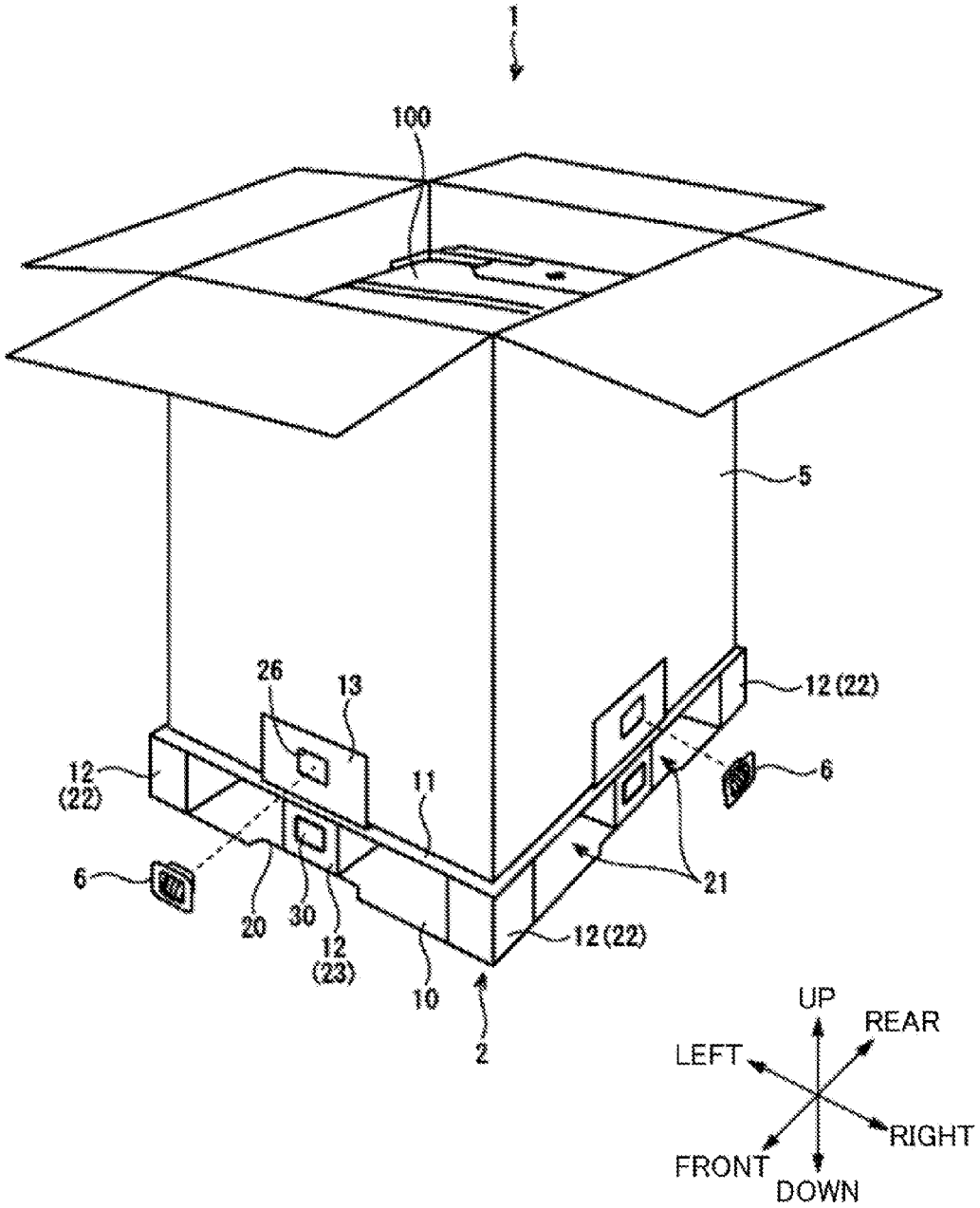
FIG. 1 is a perspective view of a packing assembly provided with a pallet according to a first embodiment.
Figure 2:
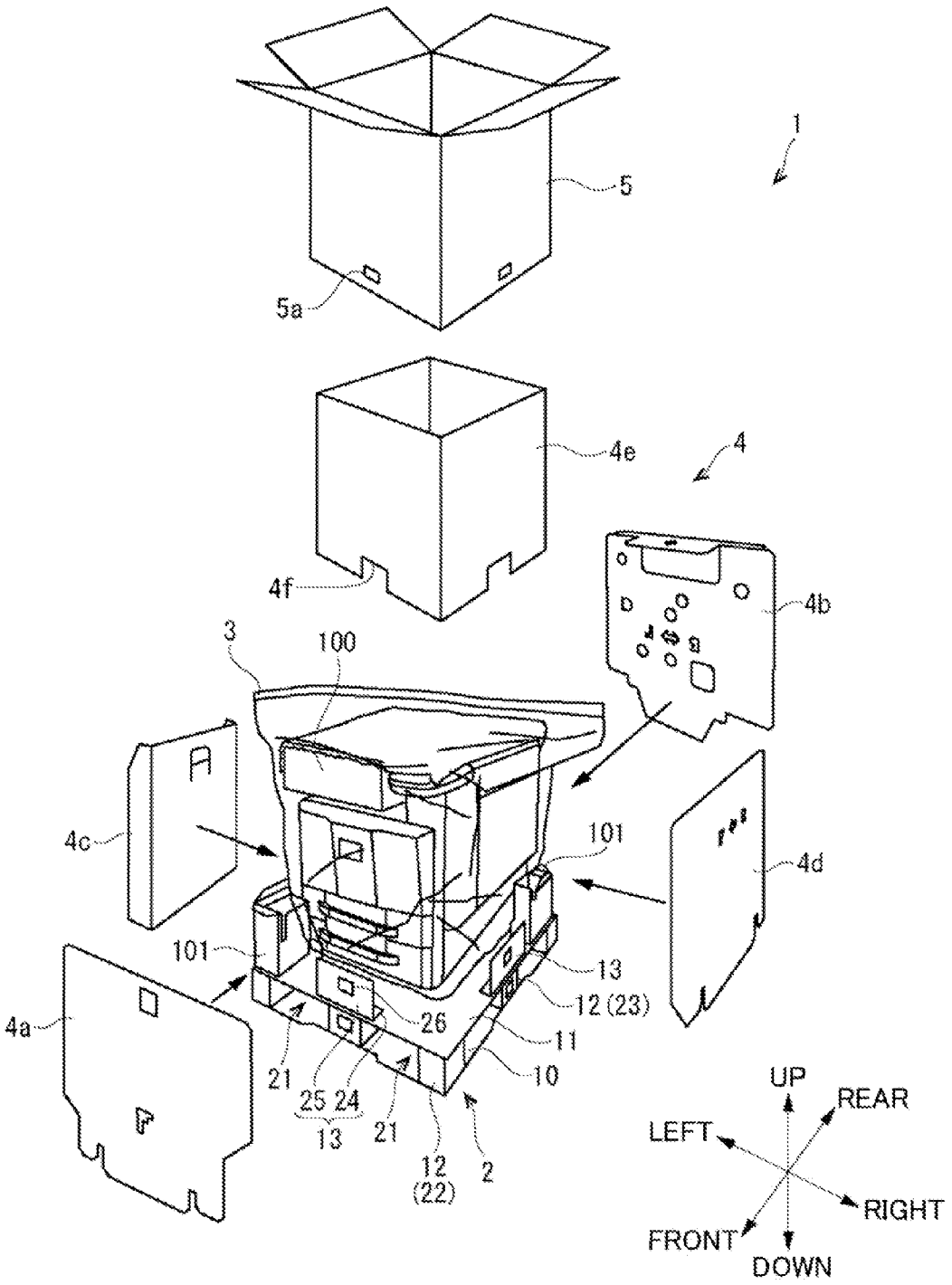
FIG. 2 is a developed perspective view showing the state in which a packing assembly provided with a pallet according to a first embodiment has been developed.
Figure 3:
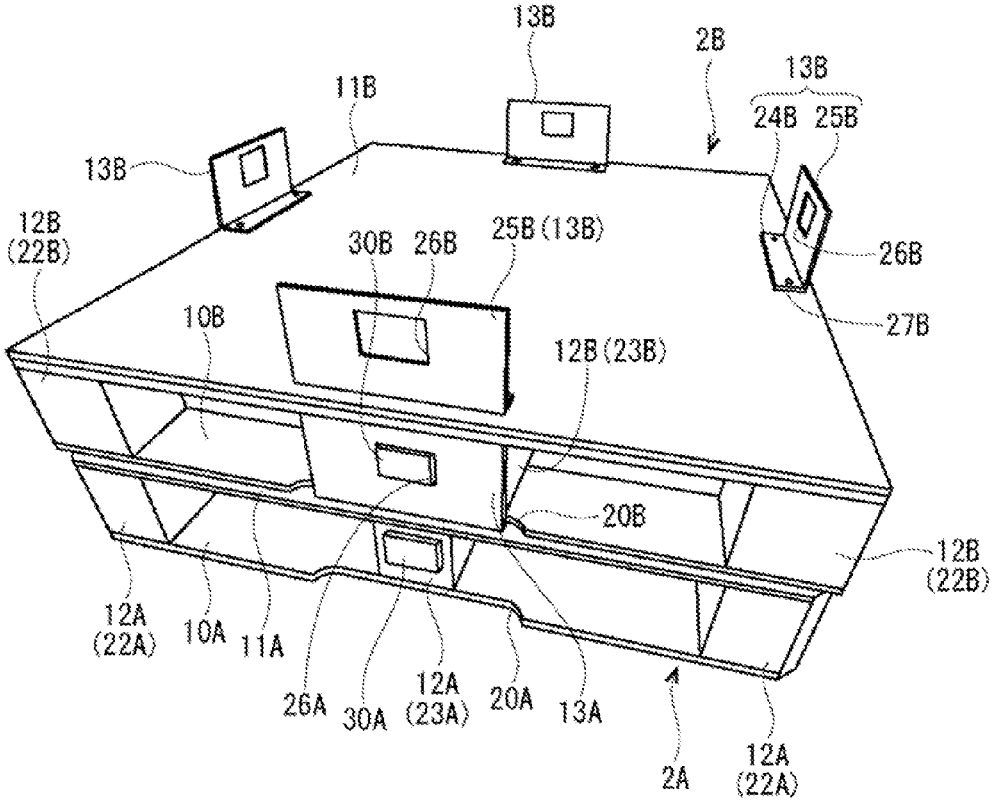
FIG. 3 is a perspective view showing the state in which a pallet according to a first embodiment has been stacked.
Figure 4:
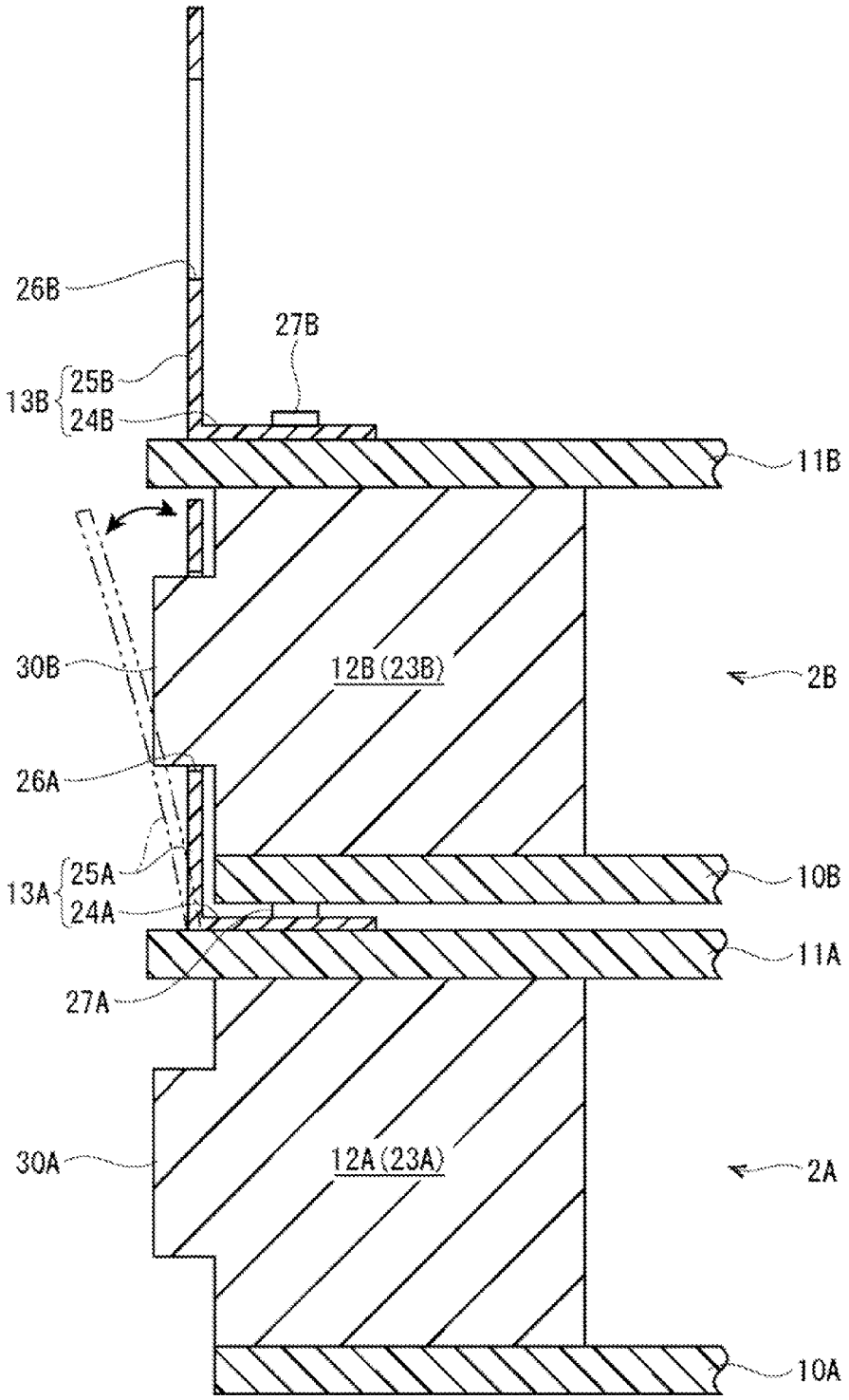
FIG. 4 is a section schematically showing a part of the state in which a pallet according to a first embodiment has been stacked.

With reference to FIG. 1 to FIG. 4, a packing assembly 1 provided with a pallet 2 according to a first embodiment will be described. FIG. 1 is a perspective view of the packing assembly 1. FIG. 2 is a developed perspective view showing the state in which the packing assembly 1 has been developed. FIG. 3 is a perspective view showing the state in which the pallet 2 has been stacked. FIG. 4 is a section schematically showing a part of the state in which the pallet 2 has been stacked.

As shown in FIG. 1, the packing assembly 1 is configured to have an external appearance of an approximately rectangular parallelepiped shape. As shown in FIG. 1 and FIG. 2, the packing assembly 1 includes the pallet 2 on which an image forming apparatus 100 as an object to be packed is placed, a bag-like vinyl cover 3 that covers the image forming apparatus 100, an inside packing member 4 that covers a peripheral side surface of the image forming apparatus 100 covered with the vinyl cover 3, and an outside packing case 5 that covers the image forming apparatus 100 covered with the inside packing member 4. In addition, the object to be packed is not limited to the image forming apparatus 100, and the object to be packed may be an arbitrary article to be packed in order to be protected from impact.

The pallet 2 includes a bottom plate 10, a top plate 11 on which the image forming apparatus 100 is placed, a plurality of leg members 12 that connect the bottom plate 10 and the top plate 11 and are disposed along the outer edges of the bottom plate 10 and the top plate 11, and a plurality of sidewall members 13 vertically installed along the outer edge of the top plate 11.

Each of the bottom plate 10 and the top plate 11 is made of wood and is formed in a rectangular shape when viewed from a plan view. Each of the bottom plate 10 and the top plate 11 is formed to have approximately the same size. The top plate 11 is opposingly disposed above the bottom plate 10. A concave section 20 having an approximately rectangular shape is notched inward from a center area of each side of the bottom plate 10.

Each of the plurality of leg members 12 is made of wood and is formed in an approximately cubic shape. The plurality of leg members 12 are provided between the bottom plate 10 and the top plate 11, respectively. In detail, the leg members 12 are disposed at four corner portions of both plates 10 and 11 and approximately center parts of each side. The eight leg members 12 are provided along the sides of the bottom plate 10 and the top plate 11 at approximately regular intervals. Between one pair of adjacent leg members 12, fork insertion openings 21 for the insertion of forks of a fork lift are formed. In addition, in the following description, for the purpose of convenience, the four leg members 12 disposed at each corner portion will be referred to as "corner leg members 22" and the four leg members 12 disposed at the approximately center part of each side will be referred to as "intermediate leg members 23".

Each intermediate leg member 23 is disposed more slightly inward than an end face of the bottom plate 10 (and the top plate 11) (at a center side of the bottom plate 10 and the like). An outer end face of the concave section 20 of the aforementioned bottom plate 10 forms the same plane with an outer side surface of the intermediate leg member 23 (referring to FIG. 1).

Each of the plurality of sidewall members 13 is formed by bending an iron sheet metal in an approximately L shape. In detail, each sidewall member 13 is integrally formed with a sidewall fixing part 24 formed in an approximately rectangular plate shape in parallel with the top plate 11 and a sidewall body 25 having an approximately rectangular plate shape extending upward from an outer end portion of the sidewall fixing part 24 (referring to FIG. 2 and FIG. 3). An angle between the sidewall fixing part 24 and the sidewall body 25 is approximately 90 °.

Each of the plurality of sidewall members 13 is fixed at an approximately center part of each side of the top plate 11. That is, each sidewall member 13 is provided above the intermediate leg member 23. Each of the four sidewall members 13 is provided along each side of the top plate 11 while the sidewall fixing part 24 is being directed inward (the center side of the top plate 11). Each sidewall member 13 is disposed more slightly inward than the end face of the top plate 11. The sidewall fixing part 24 is fixed to the top plate 11 by a plurality of (for example, two) screws 27 (referring to FIG. 3). The sidewall body 25 is configured to be displaceable with elastic force in a direction orthogonal to a side along with the sidewall body 25.

Each sidewall member 13 (the sidewall body 25) is formed with an approximately rectangular-shaped connection hole 26 that is used in a connection of the outside packing case 5 covering the image forming apparatus 100. Four connection holes 26 are formed through at the position above a center part of the sidewall body 25 (referring to FIG. 3), respectively.

As shown in FIG. 2, the inside packing member 4 includes a front side pad 4*a*, a rear side pad 4*b*, a left side pad 4*c*, a right side pad 4*d*, and an inside packing case 4*e*.

Each of the side pads 4*a*, 4*b*, 4*c*, and 4*d* is formed in an approximately rectangular plate shape by a corrugated cardboard. The front side pad 4*a*, the rear side pad 4*b*, the left side pad 4*c*, and the right side pad 4*d* respectively abut a front side surface, a rear side surface, a left side surface, and a right side surface of the image forming apparatus 100, and protect each side surface of the image forming apparatus 100.

The inside packing case 4*e* is formed in a rectangular cylindrical shape by a corrugated cardboard. The inside packing case 4*e* is configured to be able to receive the image forming apparatus 100 abutting the side pads 4*a*, 4*b*, 4*c*, and 4*d* therein. The inside packing case 4*e* is formed at lower end portions thereof with a plurality of (for example, four) rectangular-shaped inner openings 4*f*. The inner openings 4*f* are formed to be notched upward from the center lower ends of each side surface of the front, rear, left, and right of the inside packing case 4*e*.

The outside packing case 5 is formed in a rectangular cylindrical shape by a corrugated cardboard. The upper surface and the lower surface of the outside packing case 5 are opened. The upper opening of the outside packing case 5 is formed to be closed. The outside packing case 5 is formed at a lower end side thereof with a plurality of (for example, four) approximately rectangular-shaped outer openings 5*a*. The outer openings 5*a* are formed through the outside packing case 5 below the center lower side of each side surface of the front, rear, left, and right of the outside packing case 5. The outer openings 5*a* are formed at positions corresponding to the inner openings 4*f* of the inside packing case 4*e*. Furthermore, the outer opening 5*a* is formed to have approximately the same size as that of the connection hole 26 of the sidewall member 13, and is formed to have a size smaller than that of the inner openings 4*f*.

Hereinafter, with reference to FIG. 2, an assembling procedure of the packing assembly 1 will be described.

A worker places the image forming apparatus 100 covered with the vinyl cover 3 on the pallet 2 from the top. In addition, buffering members 101 are disposed at the lower corner portions of the image forming apparatus 100.

Next, the worker allows each of the side pads 4*a*, 4*b*, 4*c*, and 4*d* to abut each side surface of the image forming apparatus 100, thereby covering the inside packing case 4*e* from the top. In this state, each of the side pads 4*a*, 4*b*, 4*c*, and 4*d* is fixed to each side surface of the image forming apparatus 100. In this way, the inside packing member 4 is assembled.

Next, the worker covers the inside packing member 4 with the outside packing case 5 from the top. The lower end portion of the outside packing case 5 enters into the inner side of each sidewall member 13 of the pallet 2 (referring to FIG. 1). In this state, the connection hole 26 opened in each sidewall member 13 is fitted with each outer opening 5*a* of the outside packing case 5 and each inner opening 4*f* of the inside packing case 4*e*. Then, the worker inserts a joint member 6 into the outer opening 5*a* (the inner opening 4*f*) from the connection hole 26 of each sidewall member 13, and fixes the joint member 6 (referring to FIG. 1). In this way, the outside packing case 5 is fixed on the pallet 2, so that the assembling of the packing assembly 1 is completed.

The packing assembly 1, for example, is carried (moved) by a fork lift. At this time, forks of the fork lift are inserted into the fork insertion openings 21 of the pallet 2. In addition, by a reverse procedure of the assembling procedure of the packing assembly 1, the packing assembly 1 can be unpacked.

After the packing assembly 1 is unpacked, the pallet 2, the inside packing member 4, the outside packing case 5 and the like are collected for the purpose of reuse or recycling. The pallet 2 is a so-called returnable type to be collected and reused. Such a pallet 2 is configured to be stackable in a plurality of stages in a vertical direction in order to reduce a storage space (referring to FIG. 3). In a collection process of the pallet 2, a worker may raise and move the pallet 2 by his/her human power when a stacking number of the pallet 2 is small and the like.

As shown in FIG. 1 and FIG. 3, the pallet 2 has a configuration with a plurality of protruding portions 30 as engagement portions in order to facilitate collection work in the stacked state. The protruding portions 30 are provided in the leg members 12 (the intermediate leg members 23). When the protruding portions 30 of the pallet 2 (an upper pallet 2) are stacked on a top plate 11 of another pallet 2 (a lower pallet 2), the protruding portions 30 of the pallet 2 (the upper pallet 2) are disposed corresponding to connection holes 26 of sidewall members 13 of the other pallet 2. The protruding portions 30 are provided to protrude outward from the outer side surfaces of the intermediate leg members 23. The protruding portions 30 are formed in an approximately rectangular parallelepiped shape so as to be engaged with the connection holes 26.

Next, with reference to FIG. 3 and FIG. 4, the stacking procedure of the pallet 2 according to the first embodiment will be described. The stacking number of the pallet 2 is arbitrary, but the case in which another pallet 2 (hereinafter, referred to as a "second pallet 2B") is piled up on one pallet 2 (hereinafter, referred to as a "first pallet 2A") will be described (the stacking number is 2) in order to simplify a description. In addition, in FIG. 3 and FIG. 4, a mark "A" is added to constituent elements of the first pallet 2A and a mark "B" is added to constituent elements of the second pallet 2B. Hereinafter, in a description common to the pallets 2A and 2B, the marks "A" and "B" will be omitted.

A plurality of pallets 2A and 2B are stacked (piled up) in a posture of allowing four corner leg members 22A and 22B to be fitted with each other. First, a worker raises the second pallet 2B and places the second pallet 2B on a top plate 11A of the first pallet 2A. In detail, the worker allows four concave sections 20B formed in a bottom plate 103 of the second pallet 2B to be positioned to four sidewall members 13A of the first pallet 2A. The worker moves the second pallet 2B in a downward direction by using each sidewall members 13A of the first pallet 2A as a guide.

When the second pallet 2B moves further, protruding portions 30B protruding from four intermediate leg members 23B of the second pallet 2B abut the upper end portions of sidewall bodies 25A of the first pallet 2A. From here, when the second pallet 2B is pressed down, each protruding portion 30B elastically deforms each sidewall body 25A in an outward direction (referring to a two-dot chain line illustrated in FIG. 4). Moreover, when the second pallet 2B is pressed down, each protruding portion 30B reaches a position engageable with a connection hole 26A opened in each sidewall body 25A. Then, each sidewall body 25A is elastically deformed in an inward direction and each protruding portion 30B is fitted into the connection hole 26A (referring to FIG. 4).

By the above, the second pallet 2B is placed on the top plate 11A of the first pallet 2A at the inner sides of the four sidewall members 13A of the first pallet 2A. Exactly, a bottom plate 10B of the second pallet 2B abuts the upper surface of each screw 27A that fixes the sidewall members 13A to the top plate 11A (referring to FIG. 4). In this state, the first pallet 2A and the second pallet 2B are connected to each other. An engagement state of each protruding portion 30B and each connection hole 26A is maintained by the elastic force of each sidewall body 25A. In addition, the connection of the pallets 2A and 2B is released by a reverse procedure of the stacking.

In accordance with the pallet 2 according to the first embodiment as described above, a plurality of stacked pallets 2 are connected to each other by the protruding portions 30B (the engagement portions) engaged with the connection holes 26A. Therefore, for example, a worker can grasp the uppermost pallet 2 (the second pallet 2B) and raise tte stacked pallets 2. In this way, the worker can move the stacked pallets 2 with comfortable posture without bending deeply. In the collection process of the pallet 2, it is possible to improve the working efficiency of human power. Furthermore, regardless of the size, shape, and the like of the pallet 2, it becomes also easy that a plurality of workers move the stacked pallets 2.

In addition, a worker, for example, can put his/her hand into the connection hole 26 of the sidewall member 13 of the uppermost pallet 2 to grasp the uppermost pallet 2. In addition, the worker may also put his/her hand into the fork insertion opening 21 of the uppermost pallet 2, and raise the stacked pallets 2. In addition, for example, two workers may also grasp a pair of opposed sidewall members 13 (connection holes 26) and the like, and raise the stacked pallets 2.

Furthermore, in accordance with the pallet 2 according to the first embodiment, the sidewall members 13A of the first pallet 2A are elastically deformed such that the connection holes 26A are engaged with the protruding portions 30B of the second pallet 2B (the upper pallet 2) stacked on the top plate 11A from the outside. Consequently, only by piling up the second pallet 2B on the first pallet 2A, the connection holes 26A of the sidewall members 13A of the first pallet 2A are engaged with the protruding portions 30B of the intermediate leg members 23B of the second pallet 2B. The connection holes 26A are engaged with the protruding portions 30B, so that the plurality of stacked pallets 2 are connected to each other. That is, by simply piling up the pallets 2, the plurality of stacked pallets 2 can be connected to each other.

Moreover, in accordance with the pallet 2 according to the first embodiment, the connection holes 26 and the protruding portions 30 (the engagement portions) are provided in a plural number (four) in correspondence to the intermediate leg members 23 and the sidewall members 13.

Consequently, the stacked pallets 2 are rigidly connected to each other by the plurality of connection holes 26A and protruding portions 30B (the engagement portions). In this way, the stacked pallets 2 can maintain a stable connection state.

Second Embodiment

Figure 5:
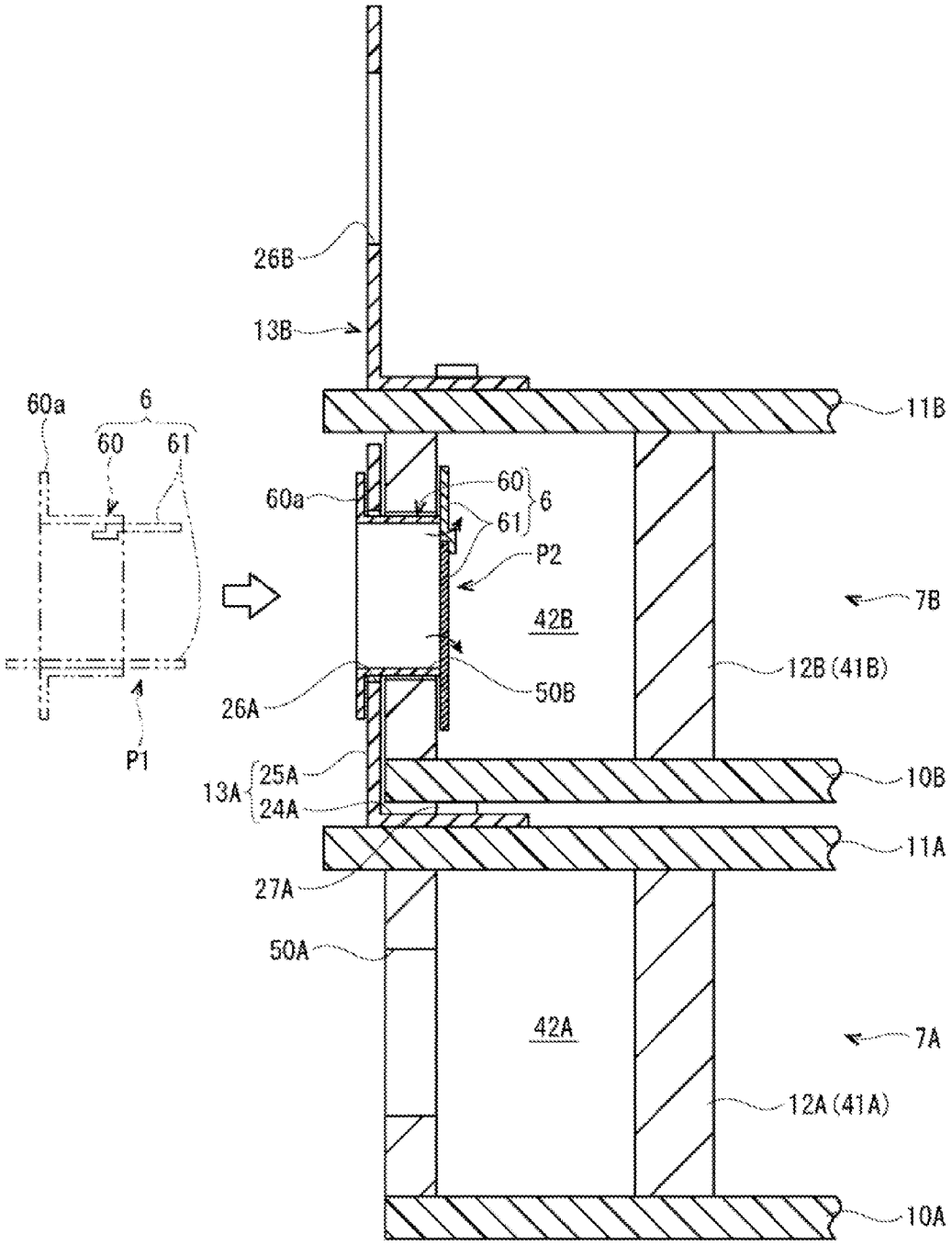
FIG. 5 is a section schematically showing a part of the state in which a pallet according to a second embodiment has been stacked.

Next, with reference to FIG. 5, a pallet 7 according to a second embodiment will be described. FIG. 5 is a section schematically showing a part of the state in which the pallet 7 has been stacked. In addition, FIG. 5 illustrates the state in which another pallet 7 (hereinafter, referred to as a "second pallet 7B") has been piled up on one pallet 7 (hereinafter, referred to as a "first pallet 7A") (the stacking number is 2). In FIG. 5, a mark "A" is added to constituent elements of the first pallet 7A and a mark "B" is added to constituent elements of the second pallet 7B. Hereinafter, in a description common to each of the pallets 7A and 7B, the marks "A" and "B" will be omitted. In addition, the same reference numerals are used to designate the same configuration as that of the pallet 2 according to the aforementioned first embodiment, and a description thereof will be omitted.

The pallet 7 according to the second embodiment has, as engagement portions, a plurality of (for example, four) connection openings 50 formed in leg members 12 (intermediate leg members 41). Furthermore, when the pallet 7 according to the second embodiment is stacked in aforementioned plurality of stages, the plurality of (for example, four) joint members 6 are used.

The four intermediate leg members 41 are formed at the same positions as those of the four intermediate leg members 23 of the pallet 2 according to the first embodiment. Each of the four intermediate leg members 41 is formed in an approximately rectangular cylindrical shape. A hollow part 42 is formed in the inner side of each intermediate leg member 41. The connection opening 50 is opened in an outer surface of each intermediate leg member 41 and is formed such that an exterior communicates with the hollow part 42. Each of the four connection openings 50 is formed in an approximately rectangular shape which is approximately same as that of the connection hole 26.

The joint members 6 are engaged with the connection holes 26 in the case of connecting the outside packing case 5. The joint member 6 includes a joint body 60 formed in an approximately rectangular annular shape, and a pair of upper and lower flaps 61 integrally formed with each other to be vertically rotatable in an inner side of the joint body 60.

The joint body 60 is formed to be insertable into the connection hole 26. The joint body 60 is provided with a flange part 60*a* that abuts an outer surface of the sidewall member 13 when the joint body 60 is inserted into the connection hole 26.

The upper flap 61 is configured to be rotatable in an upward direction toward a fixed position P2 (referring to a solid line illustrated in FIG. 5) approximately parallel with the flange part 60*a* from an insertion position P1 (referring to a two-dot chain line illustrated in FIG. 5) orthogonal to the flange part 60*a*. The lower flap 61 is formed to be vertically symmetrical to the upper flap 61, and is configured to be rotatable in a downward direction toward the fixed position P2 from the insertion position P1. In addition, in the state in which the pair of upper and lower flaps 61 has rotated to the fixed position P2, a gap is formed between each flap 61 and the flange part 60*a*. In addition, although a detailed description will be omitted, the upper flap 61 rotates together with the rotation of the lower flap 61. Furthermore, the pair of upper and lower flaps 61 are provided with lock mechanisms (not illustrated) for maintaining the state in which the pair of upper and lower flaps 61 have rotated to the fixed position P2.

In the case of assembling the packing assembly 1, a worker inserts the joint member 6, in which each flap 61 has rotated to the insertion position P1, into the outer opening 5*a* of the outside packing case 5 from the connection hole 26 of each sidewall member 13. Subsequently, the worker rotates each flap 61 to the fixed position P2. A peripheral edge portion of the connection hole 26 and a peripheral edge portion of the outer opening 5*a* are interposed between the flange part 60*a* and each flap 61. In this way, the joint member 6 is engaged not to be drawn out to the rear surface of the outside packing case 5 in the state in which the joint member 6 has been inserted into the connection hole 26 and the like (the assembling of the packing assembly 1 is completed).

Next, a stacking procedure of the pallet 7 according to the second embodiment will be described. The stacking number of the pallet 7 is arbitrary, but the case in which the second pallet 7B is piled up on the first pallet 7A will be described (the stacking number is 2) in order to simplify a description. Hereinafter, a description for the same procedure as the stacking procedure of the pallet 2 according to the first embodiment will be omitted.

The plurality of pallets 7A and 7B are stacked (piled up) in a posture of allowing the four corner leg members 22A and 22B to be fitted with one another. First, a worker moves the second pallet 7B in a downward direction by using each sidewall member 13A of the first pallet 7A as a guide. In this way, the second pallet 7B is placed on the top plate 11A (exactly, the upper surface of each screw 27A) of the first pallet 7A. In addition, the second pallet 7B smoothly enters into the inner sides of the four sidewall members 13A of the first pallet 7A without any resistance.

In the state in which the second pallet 73 has been placed on the top plate 11A of the first pallet 7A, each sidewall member 13A of the first pallet 7A is disposed along the outer surface of each leg member 123 of the second pallet 73 (an upper pallet 7) stacked on the top plate 11A. Furthermore, in this state, the connection hole 26A of each sidewall member 13A of the first pallet 7A is fitted with the connection opening 50B of each intermediate leg member 413 of the second pallet 7B.

Next, the worker inserts the joint member 6, in which each flap 61 has been rotated to the insertion position P1 (referring to the two-dot chain line illustrated in FIG. 5), into the connection opening 50 from the connection hole 26A. Subsequently, the worker rotates each flap 61 to the fixed position P2 (referring to the solid line illustrated in FIG. 5). A peripheral edge portion of the connection hole 26A and a peripheral edge portion of the connection opening 50B are interposed between the flange part 60*a* and each flap 61. In this way, each flap 61 of the joint member 6 abuts an inner surface of the hollow part 42 of the intermediate leg member 41B so as not to be drawn out. That is, the joint member 6 passes through the connection hole 26A from an exterior and is engaged with the connection opening 50B of the second pallet 7B (the upper pallet 7). In addition, the worker also fixes the other three joint members 6 in the same manner.

As described above, the first pallet 7A and the second pallet 7B are connected to each other. In addition, the connection of each of the pallets 7A and 7B is released by a reverse procedure of the stacking.

In accordance with the pallet 7 according to the second embodiment as described above, in the state in which the second pallet 7B has been piled up on the first pallet 7A, the joint member 6 is inserted into the connection hole 26A of the sidewall member 13A of the first pallet 7A, and is engaged with the connection opening 50B of the leg member 12B (the intermediate leg member 41B) of the second pallet 7B. That is, by using the joint member 6 which is used in a connection of the outside packing case 5, it is possible to connect the plurality of stacked pallets 7 to each other. In this way, the joint member 6 can also be simultaneously collected in addition to the pallets 7.

Figure 6:
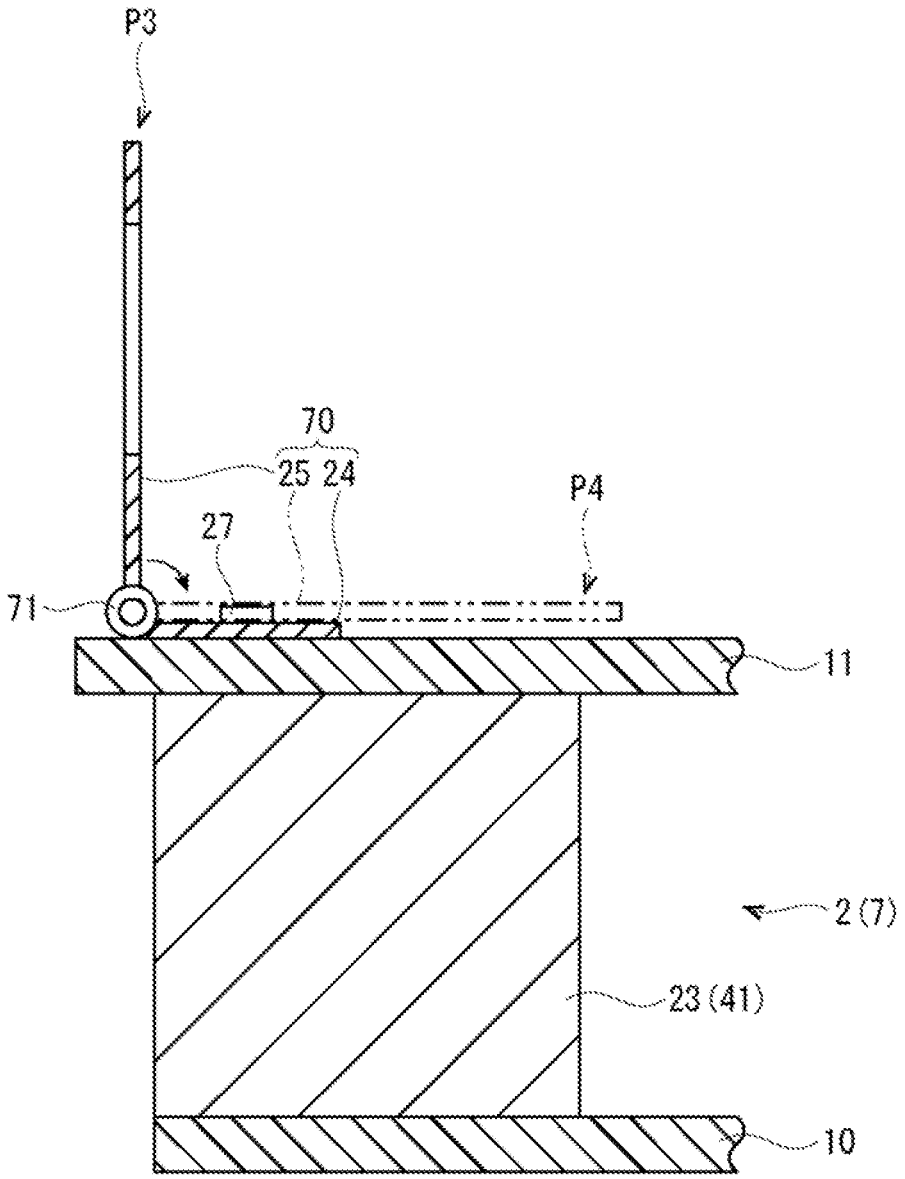
FIG. 6 is a section schematically showing a sidewall member of a pallet according to a modification of each embodiment.

In addition, the sidewall member 13 of the pallets 2 and 7 according to the first and second embodiments is formed by bending a sheet metal in an approximately L shape; however, the present invention is not limited thereto. For example, as illustrated in FIG. 6, a sidewall member 7C may also have a hinge 71 at a connection part between the sidewall fixing part 24 and the sidewall body 25. The (the sidewall body 25 of) sidewall member 70 is configured to be rotatable about the hinge 71 between an upright posture P3 and a tilting posture P4 at which the sidewall body 25 falls toward the inner side of the top plate 11. In addition, although not illustrated in the drawing, the sidewall body 25 has a hole in order to prevent interference with a head portion of the screw 27 when the sidewall body 25 has the tilting posture P4.

By allowing the sidewall member 13 of the pallets 2 and 7 positioned at stages other than the uppermost stage to have the upright posture P3, it becomes possible to stack a plurality of pallets 2 and 7 in a connection state. The sidewall member 13 of the pallets 2 and 7 positioned at the uppermost stage is allowed to have the tilting posture P4, so that it is possible to prevent the sidewall members 13 from disturbing the collection work (the carrying work) of a worker, for example. In this way, in the collection process of the pallets 2 and 7, it is possible to further improve the working efficiency of human power.

In addition, although not illustrated in the drawing, the upper end portion of the sidewall body 25 of each sidewall member 13 may also be formed to be inclined outward. Since the upper end portion of the inclined sidewall body 25 serves as a guide, a worker can smoothly perform the stacking work.

In addition, in the first and second embodiments, the inside packing member 4 and the outside packing case 5 are made of a corrugated cardboard; however, the present invention is not limited thereto. The inside packing member 4 and the outside packing case 5, for example, may also be formed using a plastic corrugated cardboard, or an arbitrary material made of wood, a metal, and the like.

In addition, the bottom plate 10, the top plate 11, and the leg member 12 of the pallets 2 and 7 according to the first and second embodiments are made of wood; however, the present invention is not limited thereto. Each of the plates 10 and 11 and the leg member 12, for example, may also be made of a resin material or a metal material, or may also be made of a corrugated cardboard and the like. Similarly, the sidewall member 13 of the pallets 2 and 7 is not limited to a member made of iron, and may also be made of a deformable arbitrary material with elastic force. In addition, the sidewall member 13 of the pallet 7 according to the second embodiment may also be made of a material (for example, wood and the like) which is not elastically deformed.

The shape, number, and arrangement of the leg member 12 (the corner leg member 22 and the intermediate leg members 23 and 41) of the pallets 2 and 7 according to the first and second embodiments are arbitrary. For example, the intermediate leg members 23 and 41 may also be provided at each side of the plates 10 and 11 in a plural number. Similarly, the shape, number, and arrangement of the sidewall member 13 (the connection hole 26) are also arbitrary. The sidewall member 13 may also be provided in a plural number in correspondence to all the intermediate leg members 23 and 41, or may also be provided in correspondence to a part of a plurality of intermediate leg members 23 and 41. Preferably, the leg member 12 (the intermediate leg members 23 and 41) and the sidewall member 13 (the connection hole 26) may also be provided at a pair of sides opposite to the top plate 11. In addition, the inner opening 4*f*, the outer opening 5*a*, and the connection hole 26 (the connection opening 50) are formed in an approximately rectangular shape, respectively; however, the present invention is not limited thereto, and they may have a shape adapted to the shape of the joint member 6.

In addition, in the pallets 2 and 7 according to the first and second embodiments, the protruding portion 30 or the connection opening 50 is provided in the intermediate leg members 23 and 41; however, the present invention is not limited thereto. For example, the protruding portion 30 or the connection opening 50 may also be provided in the corner leg member 22. In this case, the sidewall member 13 (the connection hole 26) is preferably disposed in correspondence to the protruding portion 30 or the connection opening 50.

In addition, the sidewall member 13 (70) of the pallets 2 and 7 according to the first and second embodiments is fixed to the top plate 11 by allowing the sidewall fixing part 24 to be directed inward; however, the present invention is not limited thereto. For example, the sidewall member 13 (70) may also be fixed to the top plate 11 by allowing the sidewall fixing part 24 to be directed outward. Furthermore, the sidewall member 13 (70) is fixed by the screw 27, but instead of this, the sidewall fixing part 24 may also be fixed by an adhesive and the like, or the sidewall fixing part 24 may be omitted and the lower end portion of the sidewall body 25 may also be inserted into the top plate 11. Furthermore, the sidewall member 13 (70) of the pallets 2 and 7 is formed in an approximately L shape; however, the present invention is not limited thereto. The sidewall member 13 (70) may also be formed in an approximately T shape.

In addition, since the foregoing description of the embodiments is intended to be set forth the preferable embodiments in the pallets 2 and 7, there may be a case of providing various limitations which are technically preferable. However, the technical scope of the present disclosure is not limited to these aspects. Moreover, the constituent elements in the foregoing embodiments can be appropriately replaced with existing constituent elements and the like, and various variations including a combination with any other existing constituent elements are possible. The contents set forth in the claims are not limited by the foregoing description of the embodiments.

What is claimed is:

1. A pallet stackable in a plurality of stages, the pallet comprising:

a bottom plate;

a top plate on which an object to be packed is placed;

a leg member that connects the bottom plate and the top plate and is disposed along outer edges of the bottom plate and the top plate, the leg member having an engagement portion; and a sidewall member vertically installed along the outer edge of the top plate and formed with a connection hole to be used in a connection of an outside packing case that covers the object to be packed, wherein the engagement portion is a protruding portion protruding outward from an outer side surface of the leg member, when the pallet is stacked on a top plate of a second pallet, the engagement portion is disposed in correspondence to a connection hole of a sidewall member of the second pallet, and when a third pallet is stacked on the top plate of the pallet, the sidewall member of the pallet is configured to be displaceable with elastic force such that the connection hole is engaged with a protruding portion of the third pallet protruding from an outer side.

2. The pallet of claim 1, wherein the sidewall member is configured to be rotatable between an upright posture and a tilting posture of falling toward an inner side of the top plate.

3. The pallet of claim 1, wherein each of the bottom plate and the top plate is formed in a rectangular shape, each of the leg member and the sidewall member is provided in a plural number, and each of the engagement portion and the connection hole is provided in a plural number in correspondence to the plural number of the leg member and the sidewall member.

4. A pallet stackable in a plurality of stages, the pallet comprising:

a bottom plate;

a top plate on which an object to be packed is placed;

a leg member that connects the bottom plate and the top plate and is disposed along outer edges of the bottom plate and the top plate, the leg member having an engagement portion; and a sidewall member vertically installed along the outer edge of the top plate and formed with a connection hole to be used in a connection of an outside packing case that covers the object to be packed, wherein the engagement portion is a connection opening formed in the leg member, the pallet is connectable to the outside packing case by a joint member fitted into the connection hole of the sidewall member, when the pallet is stacked on a top plate of a second pallet, the engagement portion is disposed in correspondence to a connection hole of a sidewall member of the second pallet, and when a third pallet is stacked on the top plate of the pallet, the sidewall member of the pallet is disposed along an outer side surface of a leg member of the third pallet and a connection opening of the third pallet is engageable by the joint member by passing the joint member through the connection hole of the pallet from an outer side.

5. The pallet of claim 4, wherein the sidewall member is configured to be rotatable between an upright posture and a tilting posture of falling toward an inner side of the top plate.

6. The pallet of claim 4, wherein each of the bottom plate and the top plate is formed in a rectangular shape, each of the leg member and the sidewall member is provided in a plural number, and each of the engagement portion and the connection hole is provided in a plural number in correspondence to the plural number of the leg member and the sidewall member.

* * * * *